US007675490B2

(12) United States Patent
Cok et al.

(10) Patent No.: US 7,675,490 B2
(45) Date of Patent: Mar. 9, 2010

(54) METHOD AND APPARATUS FOR UNIFORMITY COMPENSATION IN AN OLED DISPLAY

(76) Inventors: Ronald S. Cok, Eastman Kodak Company, 343 State St., Rochester, NY (US) 14650; Christopher J. White, Eastman Kodak Company, 343 State St., Rochester, NY (US) 14650; Paul J. Kane, Eastman Kodak Company, 343 State St., Rochester, NY (US) 14650

( * ) Notice: Subject to any disclaimer, the term of this patent is extended or adjusted under 35 U.S.C. 154(b) by 662 days.

(21) Appl. No.: 11/556,343

(22) Filed: Nov. 3, 2006

(65) Prior Publication Data

US 2008/0106503 A1 May 8, 2008

(51) Int. Cl.
*G09G 3/30* (2006.01)

(52) U.S. Cl. ..... 345/76; 345/77; 315/169.3

(58) Field of Classification Search ..... 345/36, 345/39, 44–46, 64, 76–88, 214, 690; 315/169.3
See application file for complete search history.

(56) References Cited

U.S. PATENT DOCUMENTS

| | | | |
|---|---|---|---|
| 4,769,292 | A | 9/1988 | Tang et al. |
| 5,061,569 | A | 10/1991 | VanSlyke et al. |
| 6,081,073 | A | 6/2000 | Salam |
| 6,473,065 | B1 | 10/2002 | Fan |

OTHER PUBLICATIONS

U.S. Appl. No. 11/093,115, filed Mar. 29, 2005, Cok et al.

CIE Technical Report, Colorimetry, CIE 15:2004, ISBN 3 901 906 33 9, 3rd Edition.

Contrast Sensitivity of the Human Eye and Its Effects on Image Quality, by Peter G.J. Barten, SPIE Optical Engineering Press, pp. 38-40., Copyright 1999.

ACS Symposium Series—Trace Residue Analysis—Chemometric Estimations of Sampling, Amount, and Error by David A. Kurtz, Editor, Pennsylvania State University, Copyright 1985, pp. 115-126.

Numerical Analysis by Burden, Faires, and Reynolds, Published by Prindle, Weber & Schmidt, Copyright 1978, ISBN 0-87150-243-7, pp. 156-163.

*Primary Examiner*—Richard Hjerpe
*Assistant Examiner*—Mansour M Said
(74) *Attorney, Agent, or Firm*—Morgan Lewis & Bockius LLP

(57) ABSTRACT

A method of compensating the uniformity of an OLED device that includes measuring the performance of light-emitting elements at three or more different input intensity values. Calculation of parameters a and b, for each light-emitting element, is performed to minimize the sum, for each of the three or more input intensity values i, of a minimization function:

$$f(y_i,i,(y_i-g(y_i,i,a,b))^2)$$

where $y_i$ is the performance value of the light-emitting element or groups of elements in response to an input intensity value i, and g is a function that is a simplified representation of the performance of the one or more light-emitting elements or groups of elements. A linear transformation function is formed as: $f(i)=mi+k$, where m and k depend upon the function g, and the parameters a and b.

20 Claims, 8 Drawing Sheets

METHOD AND APPARATUS FOR UNIFORMITY COMPENSATION IN AN OLED DISPLAY

FIELD OF THE INVENTION

The present invention relates to OLED displays having a plurality of light-emitting elements and, more particularly, to correcting brightness of the light-emitting elements in the display.

BACKGROUND OF THE INVENTION

Organic Light Emitting Diodes (OLEDs) have been known for some years and have been recently used in commercial display devices. Such devices employ both active-matrix and passive-matrix control schemes and can employ a plurality of light-emitting elements. The light-emitting elements are typically arranged in two-dimensional arrays with a row and a column address for each light-emitting element and are driven by a data value associated with each light-emitting element to emit light at a brightness corresponding to the associated data value. However, such displays suffer from a variety of defects that limit the quality of the displays. In particular, OLED displays suffer from non-uniformities in the light-emitting elements. These non-uniformities can be attributed to both the light emitting materials in the display and, for active-matrix displays, to variability in the thin-film transistors used to drive the light emitting elements.

It is known in the prior art to measure the performance of each pixel in a display and then to correct for the performance of the pixel to provide a more uniform output across the display. U.S. Pat. No. 6,081,073 entitled "Matrix Display with Matched Solid-State Pixels" by Salam, granted Jun. 27, 2000 describes a display matrix with a process and control means for reducing brightness variations in the pixels. This patent describes the use of a linear scaling method for each pixel based on a ratio between the brightness of the weakest pixel in the display and the brightness of each pixel. However, this approach will lead to an overall reduction in the dynamic range and brightness of the display and a reduction and variation in the bit depth at which the pixels can be operated.

U.S. Pat. No. 6,473,065 entitled "Methods Of Improving Display Uniformity Of Organic Light Emitting Displays By Calibrating Individual Pixel" by Fan issued Oct. 29, 2002, describes methods of improving the display uniformity of an OLED. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, the described approaches require either a lookup table providing a complete characterization for each pixel, or extensive computational circuitry within a device controller. This is likely to be expensive and impractical in most applications. In particular, the memory required to store compensation information can be costly. Hence, it is useful to minimize this cost.

One simple technique for compensating AM-OLED displays may be to measure the output of all of the pixels at two pre-determined code values corresponding to presumed luminance output levels. The output can be used to determine a common gain and offset for all of the pixels. However, this technique provides only a global adjustment for the pixels and does not address differences between the pixels. A more complex method is to measure the output of each of the pixels at the same, common pre-determined levels. The output measured for each pixel can be used to provide a custom offset and gain forming a linear approximation of the response of each pixel. However, this second technique may not provide the optimum custom offset and gain since the response of the pixels may not be linear and a linear approximation will therefore create errors at various light levels.

An alternative described in co-pending, commonly assigned patent application U.S. Ser. No. 11/093,115, filed Mar. 29, 2005 by Cok et al., is to measure the output of each pixel at a plurality of levels. The brightness of each light-emitting element at two or more, but fewer than all possible, different input signal values is measured and the measurements employed to estimate a maximum input signal value at which the light-emitting element will not emit more than a predefined minimum brightness (offset) and the rate at which the brightness of the light-emitting element increases above the predefined minimum brightness in response to increases in the value of the input signal (gain). The offset and gain values are used to modify the input signal to a corrected input signal to correct the light output of the light-emitting elements. Such an approach, while useful, still may not minimize the luminance error corresponding to the difference between the desired linear response to a code value and the actual response over the range of code values at which the pixel is operated.

One technique that can minimize the error is to employ a complete look-up table providing a correction for every code value of each pixel. However, such a solution requires a large, expensive memory. Alternatively, a correction curve may be estimated by employing a series of linear correction values defining a series of line segments. Such an approach reduces the memory storage somewhat and may provide approximate corrections but the memory requirements are still large and complex control circuitry may be required to select the appropriate line segment, increasing costs. These approaches are described in co-pending patent application Ser. No. 11/093,115, which is hereby incorporated in its entirety by reference.

There is a need therefore, for an improved method of providing uniformity in an OLED display that overcomes these objections.

SUMMARY OF THE INVENTION

In accordance with one embodiment, the invention is directed towards a method of compensating the uniformity of an OLED device that includes measuring the performance of light-emitting elements at three or more different input intensity values. Calculation of parameters a and b, for each light-emitting element, is performed to minimize the sum, for each of the three or more input intensity values i, of a minimization function:

$$f(y_i, i, (y_i - g(y_i, i, a, b))^2)$$

where $y_i$ is the performance value of the light-emitting element or groups of elements in response to an input intensity value i, and g is a function that is a simplified representation of the performance of the one or more light-emitting elements or groups of elements. A linear transformation function is formed as: $f(i)=mi+k$, where m and k depend upon the function g, and the parameters a and b.

ADVANTAGES

In accordance with various embodiments, the present invention may provide the advantage of improved uniformity in a display that reduces the complexity of calculations, minimizes the amount of data that must be stored, improves the yields of the manufacturing process, and reduces the electronic circuitry needed to implement the uniformity calculations and transformations.

DETAILED DESCRIPTION OF THE INVENTION

Figure 1:
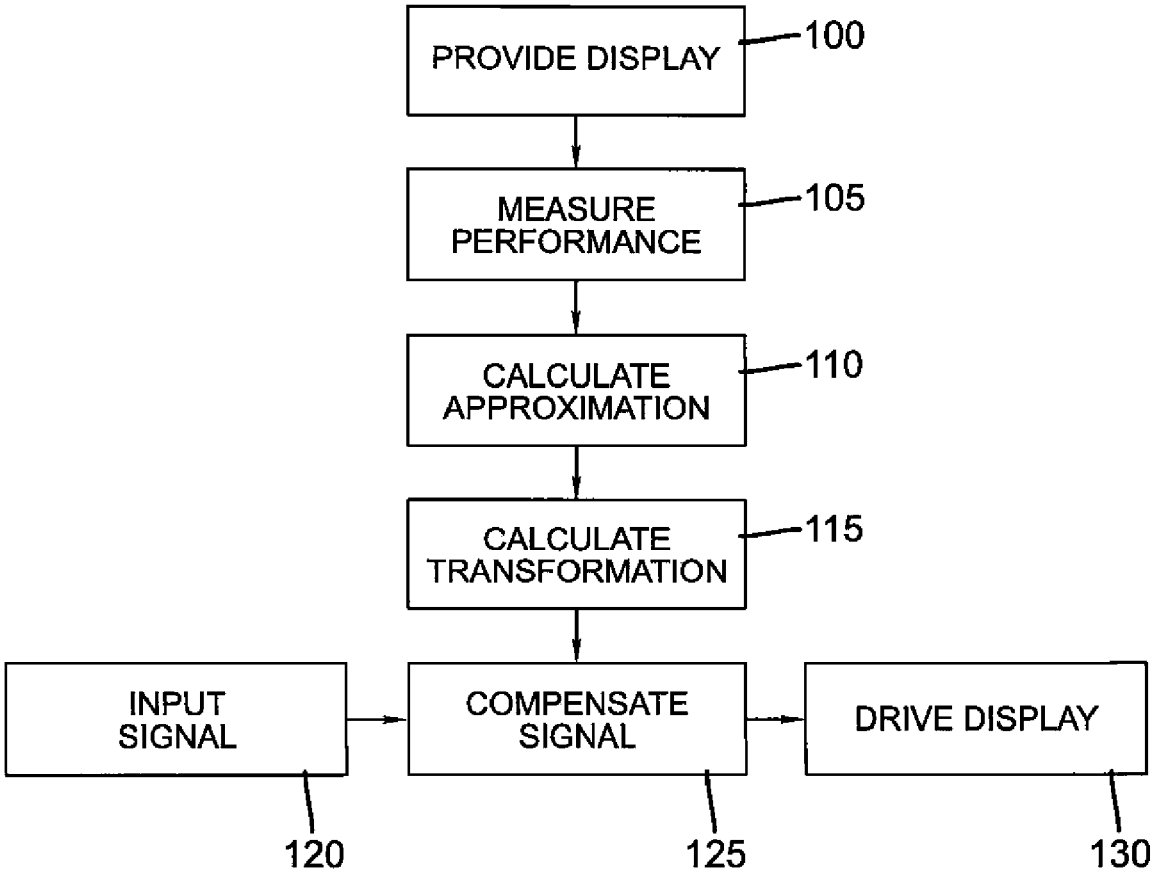
FIG. 1 is a flow diagram illustrating the method of the present invention.

Referring to FIG. 1, a method of compensating the uniformity of an OLED device having a plurality of light-emitting elements comprises a number of steps. An OLED display having one or more light-emitting elements, each light-emitting element comprising a first electrode and a second electrode and at least one light-emitting layer formed between the electrodes responsive to a current passing through the electrodes, and an electronic circuit responsive to an external controller that drives a current to pass through the electrodes, and the light-emitting layer to emit light, in response to input intensity values is provided in step 100. The performance of the one or more light-emitting elements or groups of elements at three or more different input intensity values is measured in step 105. In step 110, values a and b are calculated for each of the light-emitting elements or groups of elements to minimize the sum, for each of the three or more input intensity values i, of a minimization function:

$$f(y_i,i,(y_i-g(y_i,i,a,b))^2)$$

where $y_i$ is the performance value of the light-emitting element or group of elements in response to an input intensity value i, and g is a fitting function that is a simplified representation of the performance of the one or more light-emitting elements or groups of elements. A linear transformation function $f(i)=mi+k$, where m and k depend upon the function g, and the parameters a and b is formed in step 115. An input signal is received in step 120 and the linear transform employed in step 125 to compensate the input signal by multiplying each input signal value i by m and adding k; and the OLED display is driven in step 130 with the compensated signal.

In one embodiment, the minimization function may equal the product of a continuous weighting function $w(y_i,i)$ and $(y_i-g(y_i, i, a, b))^2$. Alternatively, the minimization function may equal $$f((y_i-(ax_i+b))^2), \text{ or}$$

$$f(i,(y_i-(ax_i+b))^2), \text{ or}$$

$$f(y_i,(y_i-(ax_i+b))^2).$$

In another embodiment of the present invention, the minimization function may be simplified to the product of a weighting function $w(y_i,i)$ and $(y_i-(ax_i+b))^2$. The minimization function is so called, because the sum of the function results is minimized by selecting the values a and b. In the case of a linear fit, the fitting function $g(y_i, i, a, b)$ equals ai+b, and in the transformation function, m is the ratio of a desired gain divided by the value a and k is a desired y-intercept minus the value b, divided by the value a.

This method, and an apparatus which implements it, efficiently compensates for non-uniformity in an OLED display. The compensation is based on measurements of the response of each light-emitting element on the display at a variety of input levels, in one embodiment in a linear intensity imaging space. For each light-emitting element, that straight line is found that best models the measured data. A linear transform is then made for each light-emitting element that will, when applied to input intensity signals, change the intensity signals into a compensated intensity signals that cause the light-emitting element in question to produce the response corresponding to the original input signal.

The present invention may improve upon the prior art by accounting for the response of the human eye when calculating the linear model of each OLED light-emitting element. The present invention forms a model that deviates most from the actual response of the light-emitting element in regions of the intensity scale where such deviations are least visible. This may improve the visual quality of the results over results delivered by the prior art, without increasing the complexity of the OLED device itself.

Figure 2:
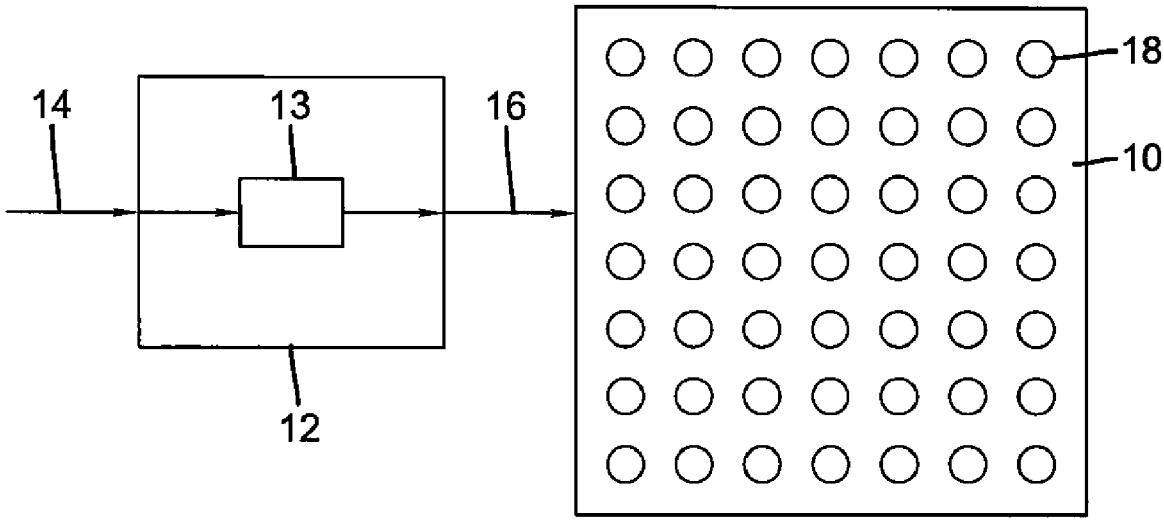
FIG. 2 is a schematic diagram illustrating an embodiment of the present invention.

Referring to FIG. 2, in one embodiment of the present invention, an OLED display device has an OLED display 10, having one or more light-emitting elements 18, and an external controller 12 for driving the display 10, in response to an input signal 14. Because the OLED display 10 may not have a preferred response to the input signal 14, the controller 12 transforms the input signal 14 to form a compensated signal 16, using circuitry 13, so that the output of the OLED display 10 more closely conforms to a desired response. Such circuitry is known in the art and may comprise, for example, digital memory and logic circuits. OLED displays, in general, are also known. In various embodiments of the present invention, the steps 100 through 115 (shown in FIG. 1) are performed as a calibration operation, for example in a factory. The linear transformation functional parameters are stored in an external controller 12 that is provided to a user, together with the corresponding display on whose performance the linear transformation functional parameters are based.

The input intensity signal 14 typically has a range of values, for example, eight bits defining an input intensity digital signal having values from 0 to 255. Such input intensity signal values are often referred to as code values. Other ranges and numbers of bits may be employed with the current invention, as may analog signals. A variety of input intensity signal values may be employed in measuring the performance of the light-emitting elements or groups of elements. The selection of input intensity signal values may be pre-determined for all of a plurality of OLED devices or may vary depending on the attributes of each individual, or group of, OLED devices. If a pre-determined selection of intensity signal values are employed, they may be chosen on the basis of the visual significance of the intensity signal values to the human visual system.

Figure 3:
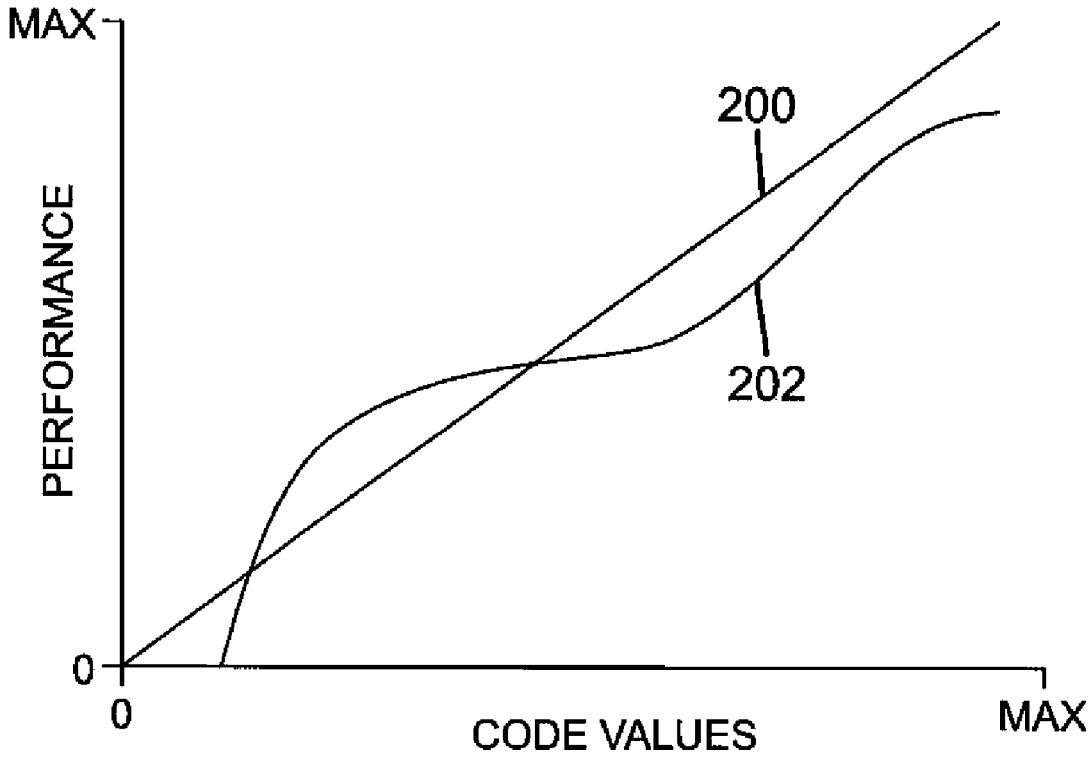
FIG. 3 is a graph illustrating response curves useful in understanding the present invention.

Referring to FIG. 3, an input signal with a desired response is illustrated with curve 200. (Note that transformations into and out of one imaging space, for example, logarithmic, into another imaging space, for example, linear, may be employed to provide a desired imaging space for the compensation operation or for driving the display itself. Such transforms are known in the art. In one embodiment, compensation is performed in a linear imaging space.) A sample curve 202 showing a more realistic response curve of an OLED display is also illustrated. Note that, because active-matrix display devices incorporate thin-film circuitry having a non-zero turn-on voltage, a minimum code value greater than 0 applied to a digital-to-analog converter to drive the display may be necessary to emit light. Moreover, the response of the sample curve 202 to increases in input intensity signal values may not provide the desired increase in light output. For example, the response may not be linear and may not have the desired slope. The present invention provides a means to compensate the input signal 14 having a desired response 200 to a compensated signal 16 that will cause an actual response, for example, the sample curve 202, to approximate the desired response. This is done by employing a linear transformation to convert the input signal 14 to a compensated signal 16. A linear transformation is employed, because the storage and computation requirements for computing the transformation are reduced. The linear transformation is found by approximating the actual performance of each light-emitting element 18 in the display 10 with a line characterizing the performance, and employing the characterization to form the linear transformation. However, because the actual performance may not be linear, the response of the display 10 to input signals 14 compensated using this simplified representation of actual performance may have some error.

Moreover, the simplified representation of the actual performance (based on the measured performance values) may not optimize the uniformity of the OLED device as perceived by a user. Consider the errors, that is, the differences between the actual performance and approximated performance, calculated for each measured intensity i as:

$$y_i - g(y_i, i, a, b).$$

Errors at some input intensity values are less objectionable to an observer than similar errors at other input intensity values. For example, errors at low code values are more noticeable than errors at relatively higher code values. Similarly, a few errors of large magnitude may be more objectionable than relatively more errors of smaller magnitude, even though the sum of the errors may be similar. In this case, a non-linear function may be employed as a weighting factor, for example, a power function, and applied to the error values at each input intensity value before summing, Hence, according to further embodiments of the present invention, the minimization function may be dependent on the input signal value itself, rather than the performance of the OLED device. In particular, since the human visual system is more sensitive to errors at lower light levels, the function may be larger for smaller values of i and smaller for larger values of i. In an alternative embodiment of the present invention, since larger errors in output are more likely to be objectionable than smaller errors, the function may be relatively larger for larger errors and smaller for smaller errors. For example, a non-linear function may be employed. In general, the function may be dependent on either, or both of, the measured performance value or the input intensity value. Moreover, the measured performance value may be the light output, for example the luminance, in response to an input intensity value or the measured performance value may be the current used by the one or more light-emitting elements or groups of elements in response to an input intensity value. Therefore, in various embodiments of the present invention, the minimization function may equal 1, or may equal $f(y_i-(ax_i+b))^2$, or may equal $f(i, (y_i-(ax_i+b))^2)$. In these embodiments, the computation of the minimization function may be somewhat simpler and may provide a transformation that is better adapted to the human visual system.

To best match the properties of the human visual system, the simplified representation of the measured performance of each light-emitting element or group of light-emitting elements may be calculated using the standard CIE Lightness metric, L*, defined in CIE Technical Report 15 (2004), *Colorimetry* (CIE 15:2004). L* is approximately perceptually uniform; that is, one L* step is equally visible to the eye, independent of its absolute value. The L* value of a particular luminance is proportional to the cube root of the ratio of that luminance to the luminance of a reference peak white. In many cases of interest, except under conditions of very high ambient illumination, the reference white may be taken to be the display peak white. Therefore, using L* requires measuring the display peak white at a desired chromaticity, for example, a D65 white of chromaticity coordinates (0.3127, 0.3290), and calculating its CIE tristimulus values Xn, Yn, and Zn (CIE 15:2004 sec. 7.1). For cases where the performance of the light-emitting elements or groups of elements is not measured in luminance, characterization before applying this method can establish a relationship between measured performance and luminance, and thus between measured performance and L*. This characterization may also be used to calculate peak white performance values Xn, Yn, and Zn in the same units as the performance measurements.

There are at least two ways to use L*. In one embodiment of the present invention, instead of fitting a line to the measured data as expressed above, fit a power function to the measured data, expressed in L*. In other embodiments, use a weighted least-squares fit in linear space, rather than an unweighted fit in L* space, to determine the coefficients a and b of the simplified representation of the actual performance. These two ways both place more emphasis on minimizing error where the eye can see it most. Full details of these techniques follow.

Prior inventions in this area have either ignored deviations from linearity in the measured performance data, or have provided means to reduce deviations mathematically without taking into account the characteristics of the human visual system. The present invention, by taking into account the human eye, may produce results visibly better than previous approaches.

The present invention's use of weighted least-squares (WLS) is also novel. Although the WLS technique has existed for many years, it is typically used by statisticians to eliminate the effect of non-constant standard deviation in a dataset. This situation applies when there are multiple measurements for any given value of the abscissa; in that case, each data point is typically given a weight of $1/\sigma^2$, where $\sigma$ is the standard deviation of the data points sharing that value of the abscissa. In this case, there is only one data point for each abscissa value, and the weights are based on studies of the human eye, not based on any characteristics of the measured performance data.

In one embodiment of the present invention, instead of fitting a line to the measured data as in the first embodiment, fit a power function to the measured data, where the measured data are expressed in L*. Now defining a function $\Lambda(y_i)$ to be the L* value corresponding to performance measurement $y_i$, computed with reference to the desired peak white performance measurement (CIE 15:2004 sec. 8.2.1.1), and an inverse function $\Gamma(L^*)$ as the conversion from an L* value back to its corresponding performance measurement, define fitting function g as:

$$g(y_i,i,a,b)=(a*x^b).$$

That is, make g a power function rather than a linear function. Then, calculate values c and d to minimize the sum, over all measurements i, of the minimization function:

$$f(\Lambda(y_i),i,(\Lambda(y_i)-g(\Lambda(y_i),i,c,d))^2).$$

This will fit a power function g to $\Lambda(y_i)$, the measured performance data in L* space. Then convert the resulting fit $\Lambda(y_i)=c*x_i^d$ back into linear space with function $\Gamma$, and, if necessary, fit a straight line to the result with any standard line-fitting technique from the mathematical art. The result will be the simplified representation of the actual performance, y=ax+b, as described above. This technique has the advantage that it uses only basic fitting techniques, but has the disadvantage of extra conversion steps.

Other embodiments of the present invention reduce the number of steps by using a weighted least-squares fit in linear space, rather than an unweighted fit in L* space, to determine the coefficients a and b of the simplified representation of the actual performance. These embodiments use as a minimization function $$w(y_i,i)(y_i-g(y_i,i,a,b))^2$$

for fitting function $$g(y_i,i,a,b)=ai+b.$$

The weight of each point $w(y_i,i)$ is selected based on the L* function, and a and b are computed with weighted least-squares techniques known in the statistical art.

In one embodiment, let $$\begin{aligned} w(y_i, i) &= r*d\Lambda/dy_i \\ &= r*(116/3)(y_i/Yn)^{-1/3}*(1/y_i), \text{ for } y_i/Yn > (24/116)^3; \\ &\quad r*(116*841/108)*(1/Yn), \text{ for } y_i/Yn <= (24/116)^3. \end{aligned}$$

for a weighting constant r and a peak white performance measurement Yn. Weighting constant r can be chosen according to the needs of the implementation. Choosing r=Yn/(116*841/108) will normalize the weights $w(y_i,i)$ so that w(0, i)=1.0. In another embodiment, let $$w(y_i,i)=r/\Lambda(y_i)$$

for some weighting constant r.

Figure 8A:
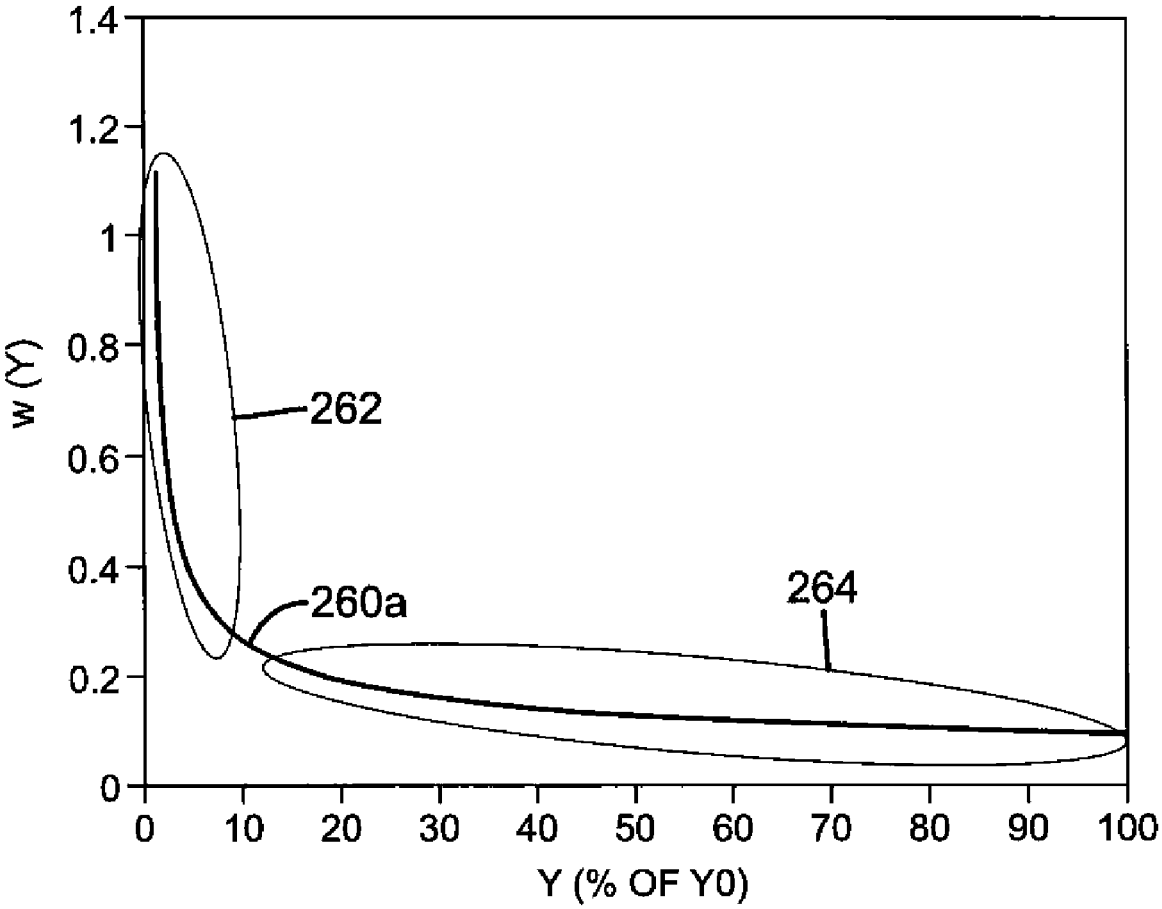
FIG. 8A shows a weighting function having two main regions.

This second embodiment $r/\Lambda(y_i)$, shown in FIG. 8A, produces a continuous weighting function 260*a* that has two main regions: a first region 262 of rapid decrease with $y_i$ increase at low $y_i$, and a second region 264 of very slow decrease with $y_i$ at high $y_i$. In this function, the transition from the first region to the second happens below 50% of the $y_i$ of a reference white. These regions and transition are characteristic of the visibility to the human eye of small luminance changes, so any weighting function with the same general characteristics as this embodiment may be used with good results. Peter Barten, in *Contrast Sensitivity of the Human Eye and its Effects on Image Quality* (SPIE Opt. Engr. Press 1999, ISBN 0-8194-3496-5) (Barten 1999), models this effect. Barten's work may be used to modify any continuous weighting function to add a third region, where one doesn't naturally occur; hence, advantageously avoiding weighting dark measurements too heavily.

Weighted least-squares fitting is known in the statistical art. For an overview of weighted least-squares, see Burden et al., *Numerical Analysis*, Boston: Prindle, Weber, & Schmidt, 1978, sec. 4.4, pp. 156-163. For an example of how weighted least-squares analysis may be used, see Mitchell, Douglas G. "Calibration-Curve-Based Analysis: Use of multiple-curve and weighted least-squares procedures with confidence band statistics", pp. 115-131, *Trace Residue Analysis: Chemometric Estimations of Sampling, Amount, and Error* (*ACS* 284). Washington, D.C.: American Chemical Society, 1985.

However calculated, the simplified representation of performance of an OLED light-emitting element or group of elements is a linear function and may be defined by two values. The first value of the simplified representation may be an offset value j representing the maximum code value at which the light-emitting element emits less than a minimum amount of light. This point corresponds to the maximum input signal value that has no response, i.e. the point at which the response curve crosses the zero point of the ordinate of a graph plotting the luminance versus the input signal value. The second value s of the simplified representation is a gain value representing the slope of a line representing the ratio of changes in response to input intensity. Since a very simple representation having only two values is stored, both the memory and the computing requirements are minimized, usefully reducing the cost of the OLED device. Although additional computation is necessary to determine the desired linear transformation, rather than simply selecting two input intensity values to approximate the OLED element performance, this additional computation can be performed in a manufacturing calibration operation and may not have any negative impact on user performance.

Figure 4:
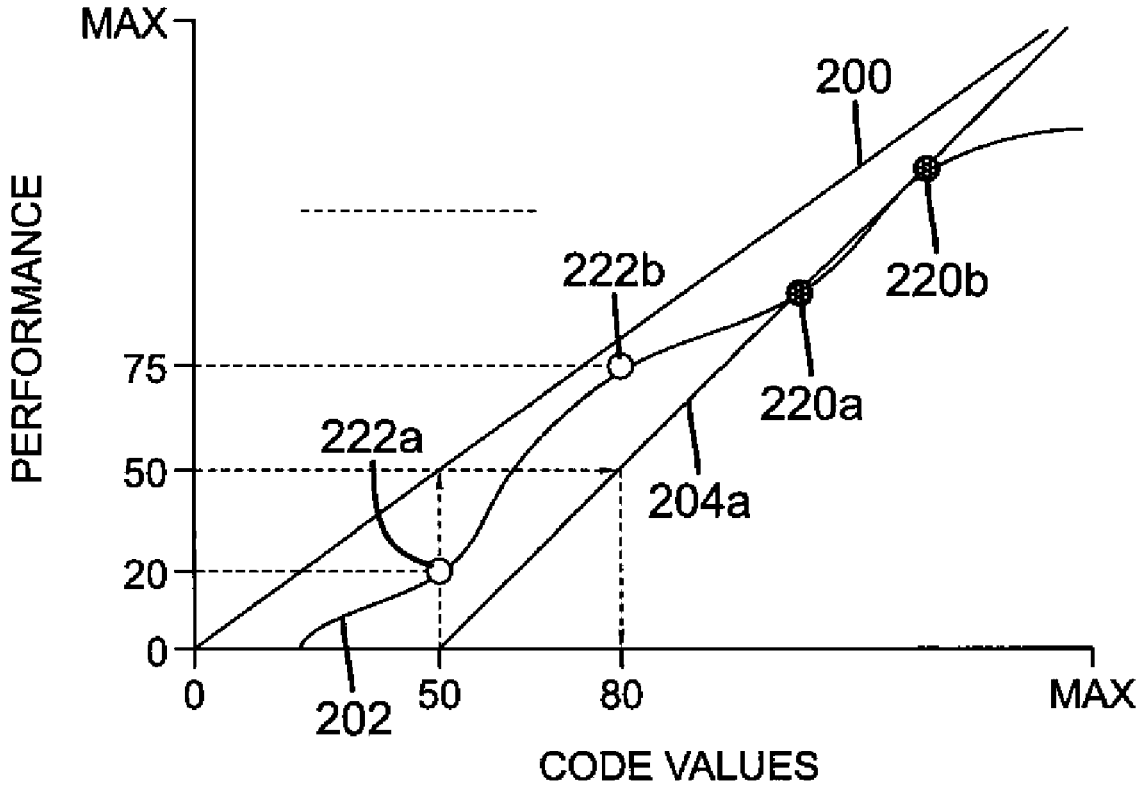
FIG. 4 is a graph illustrating a response curves and a first approximation.

Referring to FIG. 4, a desired curve 200 and an actual performance curve 202 are illustrated. The desired, corrected curve 200, typically runs from 0 to 255 (for an 8-bit system; alternatively 10- or 12-bit systems may be employed and generally any number of bits may be used depending on the OLED device application), and has a linear response in some useful light output space, so that increases in the driving signal, for example, code values, result in corresponding increases in light output across the entire range of code values. The linear curve 204*a* employs only two points to approximate the actual performance 202. The curve 204*a* is formed from the measured performance at the pair of points 220*a* and 220*b*. Employing measurements at points 220*a* and 220*b*, the linear curve 204*a* defines a linear transformation having an offset value of 50 with the illustrated gain (slope of the line). The offset j and gain s values are intended to provide a simple means to calculate a correction to an input signal to form the desired output for each light-emitting element or group of elements. Graphically, the desired input value, e.g. code value 50, is desired to drive a luminance output, shown as 50 for simplicity. However, because the response of the light-emitter (curve 202) does not correspond to the desired response curve 200, the actual luminance output will be 20, as indicated at response value point 222*a*. Using this compensation curve, an input code value of 50 is intended to provide an output of 50 with a code value of 80. However, as can be seen from the actual performance curve 202, a code value of 80 will drive an output luminance that is about 75 (point 222*b*). This may be somewhat improved over an output of 20, but the desired output of 50 is not achieved. Hence, one can conclude that the compensation curve 204*a* is inaccurate and has an error of 25=75−50 at an input code value of 50 and a compensated code value of 80.

Figure 5:
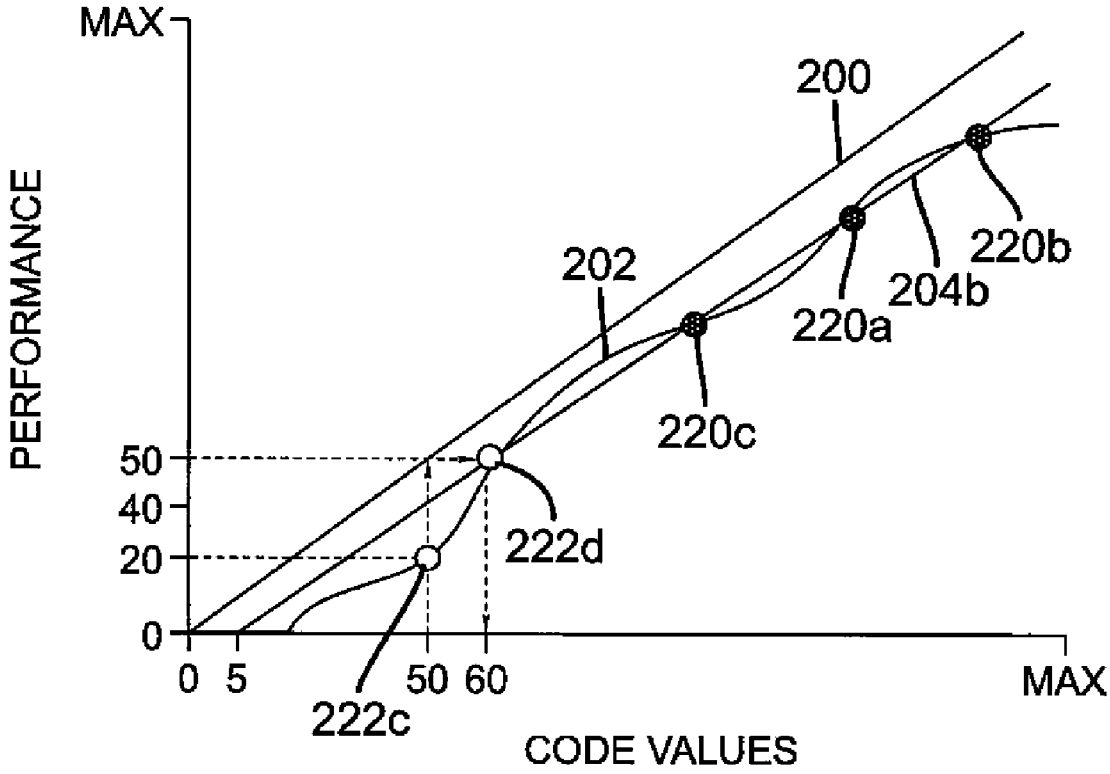
FIG. 5 is a graph illustrating a response curves and a second approximation having a smaller error according to the present invention.

Referring to FIG. 5, according to the present invention, three input intensity signal values (code values), 220*a*, 220*b*, 220*c* are employed to form the approximating curve 204*b* as described above. In this case, the offset value is approximately 5 and an input code value of 50 is linearly transformed into a code value of 60 that drives an actual performance of 50 (point 222*d*), eliminating the error at that point. Hence, compensation curve 204*b* is superior to compensation curve 204*a* and may be chosen in preference to it, demonstrating an improvement provided by the present invention. Three or more input intensity signal values may be used.

Mathematically, given a desired response, e.g. 200, and a simplified representation of actual performance with offset j and slope s, e.g. 204*b*, the linear transformation may be computed as $$f(i)=mi+k,$$

where i is the input intensity code value, m is the ratio of the slope of the desired response to the slope s of the simplified representation of the performance, and k is the y-intercept of the desired response minus the y-intercept of the simplified representation, divided by the slope s of the simplified representation. The y-intercept of the simplified representation is calculated as −sj.

Figure 6:
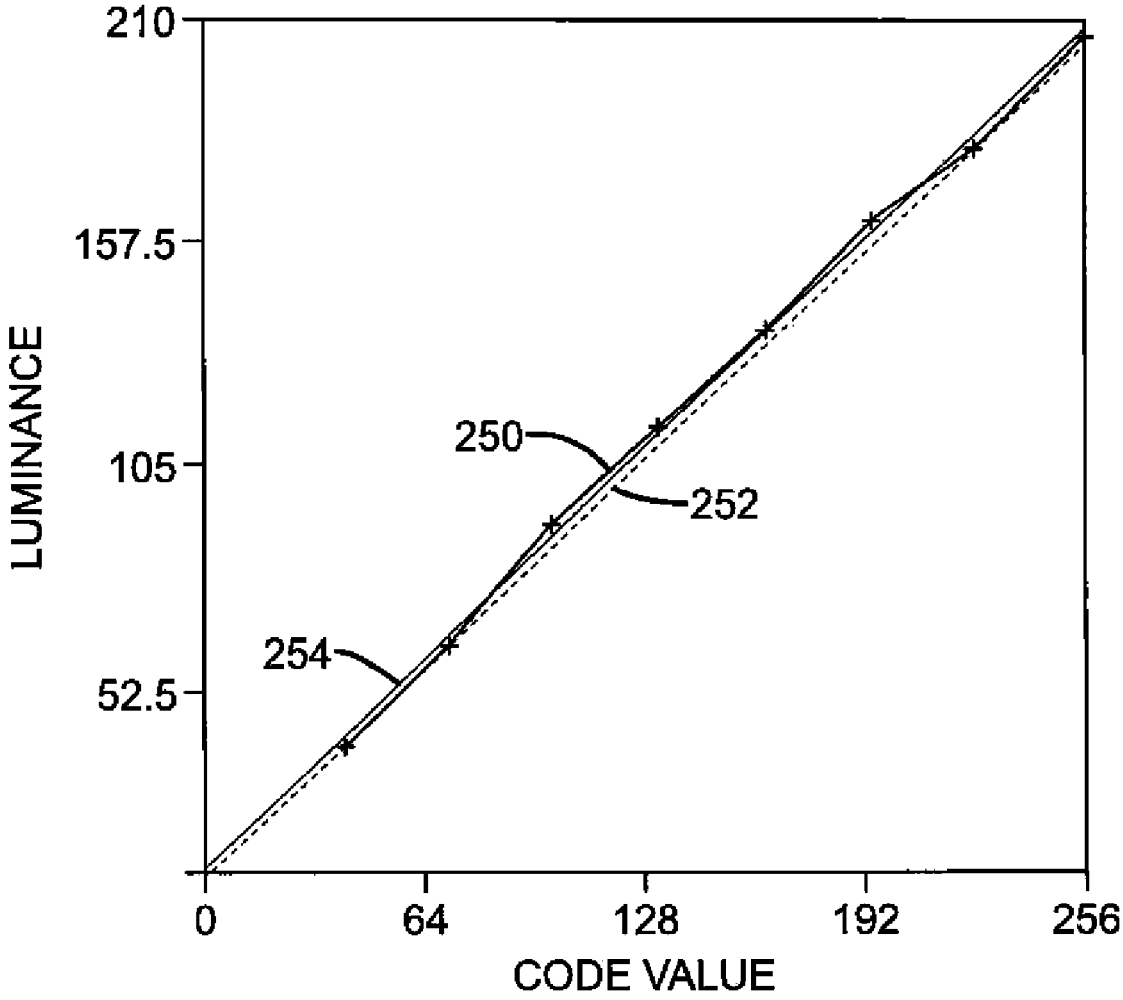
FIG. 6 is a graph illustrating response curves according to an embodiment of the present invention.

FIG. 6 is a graph illustrating actual data obtained by experimentation. Curve 250 represents the actual performance of an OLED light-emitting element. Curve 252 is a curve approximating the actual performance derived from two measured points taken near the end-points of the actual performance curve while curve 254 is an alternative approximation curve calculated according to the present invention having a lower difference (reduced error) and improved performance. While the approximate curves are not greatly different, as illustrated in the graph, the improvement is noticeable to an observer.

The different input intensity values at which performance measurements are taken may be predetermined and may be the same for each of a plurality of active-matrix OLED devices, particularly if it is known that the average performance of the plurality of OLED devices is similar. In practice, however, it is often the case that different OLED devices may have different overall characteristics. If the average performance of the plurality of OLED devices is different, it may be useful to use different pre-determined input intensity values selected on the basis of the overall OLED device performance. Hence, in one embodiment of the present invention, the same input intensity values may be chosen to measure the OLED performance for all of the light-emitting elements in a plurality of OLED devices. Alternatively, a different set of pre-determined input intensity values may be used to measure the performance of the different devices.

Figure 7:
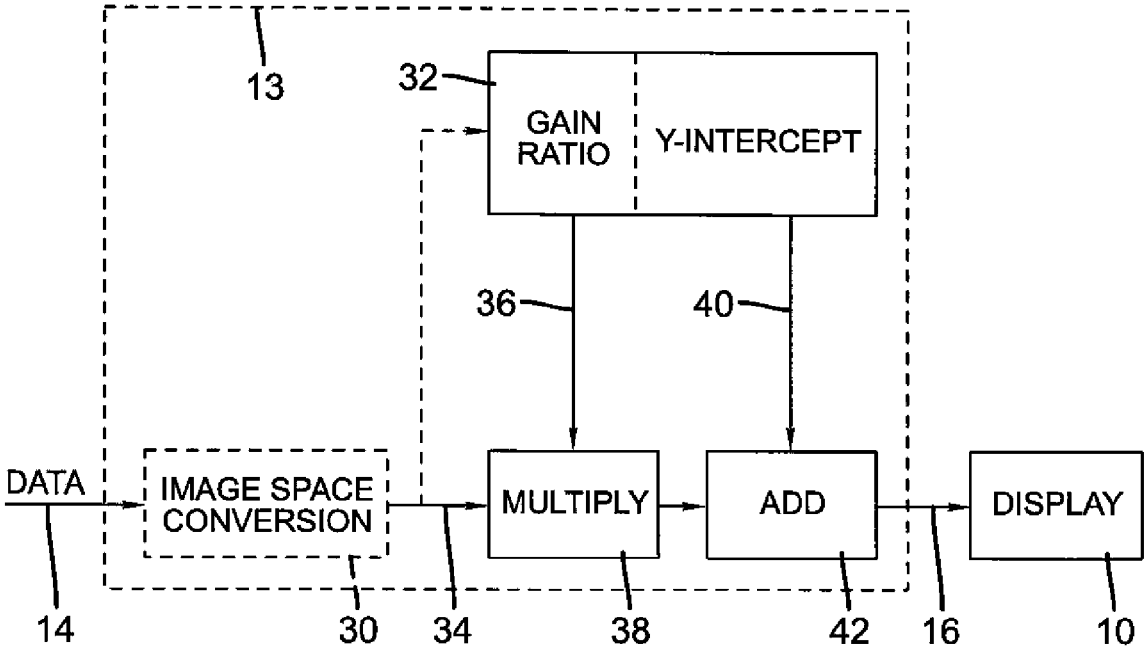
FIG. 7 is a schematic diagram according to an embodiment of the present invention.

Referring to FIG. 7, a digital linear transformation circuit 13 is illustrated showing an input signal value 14 optionally converted into a linear image space for example, in step 30 and applied to a lookup table 32 comprising gain ratio (m) and y-intercept values (k) that are applied to the image-space-converted input signal 34. The converted input signal 34 is multiplied by the gain ratio value 36 with multiplier 38, and then the y-intercept value 40 is added using adder 42 to form a compensated signal 16 that is applied to the display 10. An additional imaging space conversion may be employed (not shown) before the compensated signal 16 is applied to the display 10.

In various embodiments of the present invention, the OLED display may be a color display comprising light-emitting elements of multiple, different colors; wherein the white point of the display is adjusted by adjusting the linear transformation for each light-emitting element to modify the average brightness of the display for each color of light. The linear transformation for each light-emitting element may also be adjusted to modify the average brightness of the display or the linear transformation for each light-emitting element may be adjusted over time to compensate for decreasing display brightness. The present invention may be employed in either active or passive-matrix devices. While the weighting parameters and choice of input intensity values may be different, the minimization functions and their application to an OLED device are the same for both active and passive-matrix devices.

The present invention may employ an OLED device providing initial measurement and calibration together with an OLED device in which the measurement and calibration values form a linear transformation that is employed to compensate input signals. Such an active-matrix OLED device having a plurality of light-emitting elements may comprise an OLED display having one or more light-emitting elements, each light-emitting element comprising a first and second electrodes and at least one light-emitting layer formed between the electrodes responsive to a current passing through the electrodes, and an electronic circuit responsive to an external calibration controller causing a current to pass through the electrodes and the light-emitting layer.

The external calibration controller may calculate a linear compensation transformation function that compensates the light output of each of the plurality of light-emitting elements by measuring the performance of the one or more light-emitting elements or groups of elements at three or more different code values. The parameters a and b are calculated for each of the one or more light-emitting elements or groups of elements to minimize the sum, for each of the three or more input intensity values i, of the result of a minimization function:

$$f(y_i,i,(y_i-g(y_i,i,a,b))^2)$$

where $y_i$ is the performance value of the light-emitting element or group of elements in response to an input intensity value i, and forming a linear transformation function $f(i)=mi+k$, where m and k depend upon the function g, and the parameters a and b.

An active-matrix OLED device having a plurality of light-emitting elements may comprise an OLED display having one or more light-emitting elements, each light-emitting element comprising a first and second electrodes and at least one light-emitting layer formed between the electrodes responsive to a current passing through the electrodes, an electronic circuit responsive to an external controller causing a current to pass through the electrodes and the light-emitting layer, wherein the external controller receives an input signal and employs a linear compensation transformation function to compensate the input signal by multiplying each input signal value i by m and adding k. The OLED display is driven with the compensated signal.

The linear compensation transformation function is calculated by an external calibration controller that calculates a linear compensation transformation function that compensates the light output of each of the plurality of light-emitting elements by measuring the performance of the one or more light-emitting elements or groups of elements at three or more different code values, calculating parameters a and b for each of the one or more light-emitting elements or groups of elements that minimize the sum, for each of the three or more input intensity values i, of the result of the function:

$$f(y_i,i,(y_i-g(y_i,i,a,b))^2)$$

where $y_i$ is the performance value of the light-emitting element or group of elements in response to an input intensity value i, and forming a linear transformation function $f(i)=mi+k$, where m and k depend upon the function g, and the parameters a and b.

In further embodiments of the present invention, the linear transformation may comprise a multiplier for multiplying the input signal by a gain value and an adder for adding a y-intercept value.

To reduce the storage requirements within the circuit 13 of FIG. 3, the y-intercept k and gain ratio m values 40 and 36, respectively, in FIG. 7, for each light-emitting element may be stored together at single address locations of the lookup table 32 in FIG. 7. Alternatively, the y-intercept values 40 for each light-emitting element may be stored with a first number of bits and the gain ratio values 36 may be stored at a second number of bits, and the first and second number of bits may be different. In another embodiment, either of the y-intercept or gain values 40 and 36, respectively for each light-emitting element may be stored as a difference from a mean.

The variety of performance measurements may be made, for example by employing an optical measurement device (for example, a digital camera) for measuring the brightness of the OLED device in response to the multi-valued input signal. Alternatively, current measurements correlated to OLED performance may be employed.

In a preferred embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device, including both active- and passive-matrix OLED displays having either a top- or bottom-emitter architecture.

The invention has been described in detail with particular reference to certain preferred embodiments thereof, but it will be understood that variations and modifications can be effected within the spirit and scope of the invention.

PARTS LIST

| | |
|---|---|
| 10 | OLED display |
| 12 | external controller |
| 13 | digital linear transformation circuit |
| 14 | input signal |
| 16 | compensated signal |
| 18 | OLED light-emitting element |
| 30 | image space conversion |
| 32 | lookup table |
| 34 | converted input signal |
| 36 | gain ratio value |
| 38 | multiplier |

-continued

| | |
|---|---|
| 40 | y-intercept value |
| 42 | adder |
| 100 | provide display step |
| 105 | measure performance step |
| 110 | calculate approximation step |
| 115 | calculate linear transformation step |
| 120 | receive input signal step |
| 125 | calculate compensation step |
| 130 | drive OLED step |
| 200 | desired response curve |
| 202 | sample real response curve |
| 204a, 204b | linear function |
| 220a, 220b, 220c | measured value points |
| 222a, 222b, 222c, 222d | response value points |
| 250 | actual response curve |
| 252 | representation curve |
| 254 | preferred representation curve |
| 260a, 260b | weighting function |
| 262 | first region of a weighting function |
| 264 | second region of a weighting function |
| 266a, 266b | third region of a weighting function |

The invention claimed is:

1. A method of compensating the uniformity of an OLED device having a plurality of light-emitting elements, comprising the steps of:

a) providing an OLED display having one or more light-emitting elements, each light-emitting element comprising a first electrode and a second electrode and at least one light-emitting layer formed between the first and second electrodes responsive to a current passing through the first and second electrodes, driven by an external controller that drives a current to pass through the electrodes, and the light-emitting layer to emit light, in response to input intensity values;

b) measuring the performance of the one or more light-emitting elements or groups of elements at three or more different input intensity values;

c) calculating parameters a and b for each of the one or more light-emitting elements or groups of elements that minimize the sum, for each of the three or more input intensity values i, of a minimization function:

$$f(y_i,i,(y_i-g(y_i,i,a,b))^2)$$

where $y_i$ is the performance value of the light-emitting element or groups of elements in response to an input intensity value i, and g is a function that is a simplified representation of the performance of the one or more light-emitting elements or groups of elements;

d) forming a linear transformation function $f(i)=mi+k$, where m and k depend upon the function g, and the parameters a and b;

f) receiving an input signal;

g) employing the linear transformation function to compensate the input signal; and h) driving the OLED display with the compensated signal.

2. The method of claim 1, wherein the minimization function equals the product of a weighting function $w(y_i,i)$ and $(y_i-g(y_i, i, a, b))^2$.

3. The method of claim 2, wherein the weighting function is larger for smaller values of i and smaller for larger values of i.

4. The method of claim 2, wherein $w(y_i,i)$ for any performance measurement $y_i$ is a scaling factor times the value at $y_i$ of the first derivative of a function converting $y_i$ to CIE standard L*, or is a scaling factor divided by the value at $y_i$ of a function converting $y_i$ to CIE standard L*.

5. The method of claim 4, wherein the measured performance value is the light output, or the current used, of the one or more light-emitting elements or groups of elements.

6. The method of claim 2, wherein the weight $w(y_i, i)$ for any performance measurement $y_i$ is a scaling factor times the value at $y_i$ of a continuous weighting function, having either:

a) two main regions: a region of rapid decrease with $y_i$ increase at low $y_i$, and a region of very slow decrease with $y_i$ at high $y_i$, and in which the transition from the first region to the second happens below 50% of the $y_i$ of a reference white; or b) three main regions: a region of constant or increasing weight with $y_i$ increase at very low $y_i$, a region of rapid decrease with $y_i$ increase at low $y_i$, and a region of very slow decrease with $y_i$ increase at high $y_i$; and in which the transition from the first region to the second happens below 20% of a reference white, and the transition from the second region to the third happens below 50% of the $y_i$ of a reference white.

7. The method of claim 1, wherein the minimization function equals $f(y_i-(ax_i+b))^2)$, or $f(i, (y_i-(ax_i+b))^2)$, or $f(y_i, (y_i-(ax_i+b))^2)$.

8. The method of claim 1, wherein the function g is a power function.

9. The method of claim 1, wherein the minimization function is non-linearly larger for larger values of $y_i-g(y_i, i, a, b)$ and non-linearly smaller for smaller values of $y_i-g(y_i, i, a, b)$.

10. The method of claim 1, further comprising a plurality of active-matrix OLED devices and wherein the input intensity values selected are the same for each of the plurality of active-matrix OLED devices.

11. The method of claim 1, further comprising a plurality of active-matrix OLED devices and wherein the input intensity values selected are different for each of at least two of plurality of active-matrix OLED devices.

12. The method of claim 1, wherein the OLED display is a color display comprising light-emitting elements of multiple colors and a different linear transformation is determined for different colors of light-emitting elements.

13. The method of claim 1, wherein the OLED display is a color display comprising light-emitting elements of multiple colors and wherein the white point of the display is adjusted by adjusting the linear transformation for each light-emitting element or group of light-emitting elements to modify the average brightness of the display for each color of light.

14. The method of claim 1, wherein the linear transformation for each light-emitting element or group of elements is adjusted to modify the average brightness of the display.

15. The method of claim 1, wherein the linear transformation for each light-emitting element or group of light-emitting elements is adjusted over time to compensate for decreasing display brightness.

16. The method of claim 1, wherein the function $g(y_i, i, a, b)$ equals ai+b, and wherein m is the ratio of a desired gain divided by the value a and k is the desired y-intercept minus the value b, divided by the value a.

17. An OLED device having a plurality of light-emitting elements, comprising:

a) an OLED display having one or more light-emitting elements, each light-emitting element comprising a first and second electrodes and at least one light-emitting layer formed between the electrodes responsive to a current passing through the electrodes;

b) an external calibration controller causing a current to pass through the electrodes and the light-emitting layer;

c) wherein the external calibration controller calculates a linear compensation transformation function that compensates the light output of each of the plurality of light-emitting elements by:

i) measuring the performance of the one or more light-emitting elements or groups of elements at three or more different code values;

ii) calculating parameters a and b for each of the one or more light-emitting elements or groups of elements that minimize the sum, for each of the three or more input intensity values i, of a minimization function:

$$f(y_i,i,(y_i-g(y_i,i,a,b))^2)$$

where $y_i$ is the performance value of the light-emitting element or group of elements in response to an input intensity value i, and g is a function that is a simplified representation of the performance of the one or more light-emitting elements or groups of elements; and iii) forming a liner transformation function $f(i)=mi+k$, where m and k depend upon the function g, and the parameters a and b.

18. An OLED device having a plurality of light-emitting elements, comprising:

a) an OLED display having one or more light-emitting elements, each light-emitting element comprising a first and second electrodes and at least one light-emitting layer formed between the electrodes responsive to a current passing through the electrodes;

b) an external controller causing a current to pass through the electrodes and the light-emitting layer;

c) wherein the external controller receives an input signal and employs a linear compensation transformation function to compensate the input signal by multiplying each input signal value i by m and adding k; and drives an OLED display with the compensated signal, wherein the linear compensation transformation function is calculated by an external calibration controller that calculates a linear compensation transformation function that compensates the light output of each of the plurality of light-emitting elements by:

i) measuring the performance of the one or more light-emitting elements or groups of elements at three or more different code values;

ii) calculating the parameters a and b for each of the one or more light-emitting elements or groups of elements that minimize the sum, for each of the three or more input intensity values i, of a minimization function:

$$f(y_i,i,(y_i-g(y_i,i,a,b))^2)$$

where $y_i$ is the performance value of the light-emitting element or group of elements in response to an input intensity value i, and g is a function that is a simplified representation of the performance of the one or more light-emitting elements or groups of elements; and iii) forming a liner transformation function $f(i)=mi+k$, where m and k depend upon the function g, and the parameters a and b.

19. The OLED device of claim 18, wherein the values m and k for each light-emitting element are stored together at single address locations of the lookup table.

20. The OLED device of claim 18, wherein the values m for each light-emitting element are stored with a first number of bits and the values k are stored at a second number of bits, and wherein the first and second number of bits are different or are stored as a difference from a mean.

* * * * *